United States Patent [19]

Heidel et al.

[11] Patent Number: 4,657,801

[45] Date of Patent: Apr. 14, 1987

[54] NONWOVEN WITH FIBROUS COATING

[75] Inventors: Peter Heidel; Franz Kaulich; Heinz Artus, all of Bobingen, Fed. Rep. of Germany

[73] Assignee: Hoechst Aktiengesellschaft, Fed. Rep. of Germany

[21] Appl. No.: 780,556

[22] Filed: Sep. 26, 1985

[30] Foreign Application Priority Data

Sep. 28, 1984 [DE] Fed. Rep. of Germany ..... 3435640

[51] Int. Cl.[4] ..... B32B 3/10

[52] U.S. Cl. ..... 428/137; 427/180; 428/283; 428/288; 428/289; 428/290; 428/291; 428/300

[58] Field of Search ..... 428/283, 288, 289, 290, 428/291, 131, 137, 300; 427/180

[56] References Cited

U.S. PATENT DOCUMENTS 4,287,248 9/1981 Gessner et al. ..... 428/137

FOREIGN PATENT DOCUMENTS 2123452 7/1982 United Kingdom .

*Primary Examiner*—Marion C. McCamish

*Attorney, Agent, or Firm*—Connolly and Hutz

[57] ABSTRACT

A nonwoven which comprises fibers or filaments consolidated with a binder and which is suitable for use as a carrier web in roofing sheets which are resistant to jump fire and radiant heat is obtained by applying, together with the binder, solid particles which are resistant to heat and fire and whose spatial extension in at least one dimension is large compared with the effective hole size of the web layer. This size ratio ensures that the solid particles form a layer on the web which becomes firmly bonded to the fiber or filament web.

6 Claims, No Drawings

NONWOVEN WITH FIBROUS COATING

The present invention relates to a nonwoven which predominantly comprises synthetic fibers and is provided with a layer of inert fibrous solid particles and which is suitable for use as a carrier web in roofing sheets which are resistant to jump fire and radiant heat. Such roofing sheets are usually coated with bitumen on one or both sides, but can also have a coating made from elastomers or plastomers.

To improve the fire behavior of such roofing sheets in accordance with DIN No. 4102/part 7, laminate materials of the type described for example in German Pat. No. 2,827,136 are frequently used as carrier webs.

German Offenlegungsschrift No. 3,226,041 discloses applying to a loose, i.e. unconsolidated, mineral fiber web a thin layer of likewise loose plastics fibers and consolidating this laminate material by needling. By means of a heat treatment it is possible to fuse the plastics fibers to the mineral fibers. This fusing has the effect of producing dimensionally stable mineral fiber blankets.

German Utility Model No. 7,739,489 discloses as a carrier web for roofing sheets a laminate material comprising a synthetic fiber web and a mineral fiber web. The two layers of synthetic and mineral fiber material are bonded to each other in the reference cited by means of a binder or adhesive, for which thermoplastic and crosslinking thermosetting resins are used.

Such carrier webs lead to roofing and sealing sheets having sufficiently high processing stability in bitumening and in laying. Their dimensional stability even permits single-layer laying on the roof. The fire behavior of these roofing sheets as defined in DIN No. 4102/part 7 is distinctly improved by the mineral fiber layer.

By contrast, carrier webs made of blend webs of mineral and synthetic fibers of the type described in German Utility Model No. 7,723,547 give no adequate improvement of the fire behavior.

It has already been proposed to produce nonwovens from flame-retardant fiber raw materials. However, the use of such fiber and filament raw materials in the production of the required nonwovens did not lead to the desired success: use of the technique was unable to prevent the fire from spreading to the lower layers of a roof cover. Nor were flame-retardant additives to the bitumen material or polymer material successful. In the event of a fire the flame-retardant additives flow away together with the bitumen, so that the nonwoven remaining behind and the lower layers are no longer protected by these additives.

It has further been proposed to provide the nonwoven with a flame-retardant finish known per se which is inert at the processing temperatures of the coating material and the roofing sheet but at higher temperatures then forms a largely continuous, preferably foamlike, layer.

Insofar as the known carrier webs are composed of two largely completed fiber web layers which are then subsequently bonded to each other by various techniques, it is virtually unavoidable for there to remain a certain tendency to delaminate under extreme mechanical and/or thermal conditions.

Moreover, although they show an improvement in the fire behavior, their manufacture from two layers is technically complicated.

These disadvantages are overcome by the nonwoven according to the invention. It has been found, surprisingly, that the fire behavior of nonwovens made of binder-consolidated fibers or filaments, and of roofing sheets prepared therefrom, is distinctly improved when the nonwoven contains a layer of inert fibrous solid particles distributed in the binder.

Inert is to be understood as meaning that the solid particles are resistant to the action of heat and fire, i.e. are non-flammable or low-flammable.

For the purposes of the present invention, fibrous solid particles have a spatial extension which, in at least one dimension, is large compared with the fiber web layer's effective hole size, as defined for geotextiles in number 56 (1983) of Mitteilungen des Franzius-Instituts für Wasserbau-und Küsten-Ingenieurwesen der Universität Hannover, pages 379 to 381.

Examples of such fibrous solid particles are mineral fibers, in particular short cut staple fibers, as used for preparing wet-laid webs and which are prepared by cutting or grinding mineral wools, glass fibers or ceramic fibers. These mineral fibers usually have diameters between 5 and 50 μm, and their length can be between 50 μm and 18 mm. In practice, however, the upper limit of the longitudinal extension of the fibrous solid particles is set by their dispersibility in the dissolved or emulsified binder.

The fibrous solid particles used can however also be other shaped structures from inert materials, provided their spatial extension in at least one dimension is large compared with the effective hole size of the fiber web layer and provided they are dispersible in the binder.

Instead of mineral fibers, the inert fibrous solid particles used can also be cellulose fibers with a flame-resistant finish or other fibers which confer on the nonwoven according to the invention other properties, in addition to flameproofness, which are not possessed by one-material nonwovens, for example color or colorability, better adhesion to coatings, hydrophilicity or hydrophobicity, electrical conductivity or antistatic effects (metallic fibers) or differential shrinkage potential for producing crimp effects.

To consolidate nonwovens, binders are frequently used in the form of aqueous dispersions or aqueous solutions. Known binders in the form of aqueous dispersions are homopolymers, copolymers or terpolymers of acrylate esters, acrylamides, acrylonitrile, butadiene and styrene.

However, binders which are particularly suitable for preparing the nonwoven according to the invention are based on water-soluble urea-formaldehyde, melamine-formaldehyde and phenol-formaldehyde condensates or water-dispersible polymers of vinylidene chloride and vinyl chloride which are used alone or mixed.

The binders can be applied by various methods, for example those described in "Vliesstoff" [Nonwoven], G. Thieme Verlag Stuttgart, New York, edited by J. Lünenschloss and W. Albrecht 1982, pages 177 to 199. The most common method is padding in a box followed by passage through a pair of squeeze rollers. By heating the binder is removed from water, and binder-filament binder forms.

The nonwoven to be consolidated with these binders can comprise fibers or filaments of the known synthetic polymers. However, preference is given to a nonwoven comprising needled filaments of polyester, preferably polyethylene terephthalate, which has been formed by the known spunbond process, i.e. by laying freshly spun polyester filaments to form a web.

The inert fibrous solid particles are preferably added to the aqueous binder liquor and are kept in suspension by stirring. However, the solid particles can also be prevented from settling out by addition of a thickener, for example a thickener based on soluble cellulose derivatives.

To prepare the nonwoven according to the invention, the binder is applied together with the inert fibrous solid particles dispersed therein to the web of fibers or filaments of synthetic polymers from one side.

However, it is also possible to impregnate this web of fibers or filaments of the known synthetic polymers with the binder and then to apply the inert fibrous solid particles.

The first result on the web of fibers or filaments is the formation of a laminar accumulation of the inert fibrous solid particles, which, in the course of the subsequent evaporation of the water introduced into the web together with the aqueous binder suspension and the hardening of the binder, is firmly incorporated in this binder and forms together with the consolidated web of fibers or filaments the nonwoven according to the invention.

The resulting layer formation is critically affected by the restriction in size of the inert fibrous solid particles to those having a spatial extension in at least one dimension which is large compared with the effective hole size of the web layer, since as a result penetration into the lower web layer is largely avoided.

In the nonwoven according to the invention, the inert fibrous solid particles content can be between 30 and 200 g/m$^2$, and that of the other fibers and filaments between 50 and 350 g/m$^2$. The proportion of inert fibrous solid particles should account for between 10 and 50%, preferably between 20 and 30%, of the total weight of the nonwoven according to the invention.

We claim:

1. A nonwoven comprising a fiber web layer with holes extending therethrough, a layer of fibrous solid particles attached to the fiber web layer, the fibrous particles having a longitudinal extension larger than the effective hole size of the fiber web layer and a binder consolidating and fixing both layers to each other.

2. A nonwoven as in claim 1 wherein the fiber web layer comprises a needled fleece of polyester filaments produced by a spunbond process.

3. A nonwoven as in claim 1 wherein the fibrous solid particles comprise short out staple fibers of inorganic material having a length of between 50 μm and 18 mm.

4. A nonwoven as in claim 1 wherein the layer of fibrous solid particles has a 10 to 50% of the total weight of the nonwoven.

5. A process for the production of a nonwoven comprising the steps of producing a fiber web layer with holes extending therethrough, producing in a liquid binder a suspension of fibrous solid particles of the type having a longitudinal extension larger than the effective hole size of the fiber web layer, applying the suspension to one side of the fiber web layer, and hardening the binder.

6. A process for the production of a nonwoven comprising the steps of producing a fiber web layer with holes extending therethrough, impregnating the fiber web layer with a liquid binder, sprinkling fibrous solid particles of the type having a longitudinal extension larger than the effective hole size of the fiber web layer onto one side of the impregnated fiber web layer, and hardening the binder.

* * * * *